US010808385B2

(12) United States Patent
Hamann

(10) Patent No.: US 10,808,385 B2
(45) Date of Patent: Oct. 20, 2020

(54) ANTIMICROBIAL SINK

(71) Applicant: BK Resources, Inc., Altamont, IL (US)

(72) Inventor: Michael Hamann, Altamont, IL (US)

(73) Assignee: BK Resources, Inc., Altamont, IL (US)

( * ) Notice: Subject to any disclaimer, the term of this patent is extended or adjusted under 35 U.S.C. 154(b) by 0 days.

(21) Appl. No.: 15/916,143

(22) Filed: Mar. 8, 2018

(65) Prior Publication Data

US 2019/0277012 A1 Sep. 12, 2019

(51) Int. Cl.
*E03C 1/14* (2006.01)
*E03C 1/04* (2006.01)

(52) U.S. Cl.
CPC ..... *E03C 1/14* (2013.01); *E03C 1/0401* (2013.01)

(58) Field of Classification Search
CPC ..... E03C 1/04; E03C 1/042; E03C 1/0401; E03C 1/18
USPC ..... D23/284, 270, 271, 285, 288; 285/139.1–139.3, 192, 201, 8
See application file for complete search history.

(56) References Cited

U.S. PATENT DOCUMENTS 809,720 A * 1/1906 Mueller ..... E03C 1/0401 285/193
2,493,362 A * 1/1950 Rocker ..... A47K 13/02 4/234
3,387,309 A * 6/1968 Johnson ..... E03C 1/042 137/606
3,774,245 A * 11/1973 Greppi ..... A47K 1/00 4/310
4,110,851 A * 9/1978 Rapatel ..... A47K 1/04 4/628
D382,332 S * 8/1997 Schwartz ..... D23/284
D387,418 S * 12/1997 Laguera Garza ..... D23/284
6,241,091 B1 * 6/2001 Moore ..... A47B 81/02 206/349
8,789,555 B2 * 7/2014 Ball ..... E03C 1/042 137/359
9,051,720 B1 * 6/2015 Jones ..... E03C 1/042
D753,803 S * 4/2016 Gompper ..... D23/284
2009/0206712 A1 * 8/2009 Bendah ..... A47B 77/022 312/140.4

* cited by examiner

*Primary Examiner* — Erin Deery
(74) *Attorney, Agent, or Firm* — Locke Lord LLP; Georgi Korobanov; Daniel J. Fiorello

(57) ABSTRACT

A sink includes a body defining a bowl and a faucet holder, wherein the body is formed of an antimicrobial material, wherein the faucet holder includes at least a faucet hole defined through the faucet holder, and a faucet mounted to the faucet holder at the faucet hole.

12 Claims, 9 Drawing Sheets

ANTIMICROBIAL SINK

BACKGROUND

1. Field

The present disclosure relates to sinks, more specifically to antimicrobial sinks.

2. Description of Related Art

Existing sinks for washing hands can be a venue for microbial growth, especially in public restrooms and/or portable restrooms. Such conventional methods and systems have generally been considered satisfactory for their intended purpose. However, there is still a need in the art for improved sinks. The present disclosure provides a solution for this need.

SUMMARY

In accordance with at least one aspect of this disclosure a sink can include a body defining a bowl and a faucet holder, wherein the body is formed of an antimicrobial material, wherein the faucet holder includes at least a faucet hole defined through the faucet holder, and a faucet mounted to the faucet holder at the faucet hole. The anti-microbial material can be an antimicrobial plastic, for example, or any other suitable material.

The at least one faucet holder can include at least one faucet control hole defined through the faucet holder. The faucet holder can include two faucet control holes defined through the faucet holder.

At least one of the faucet control holes or the faucet hole can include at least one material support ring defined on a rear side of the faucet holder to provide additional support to the faucet and/or faucet controls. The at least one material support ring can extend outward from a rear side of the faucet holder to form a cylindrical shape.

The at least one material support ring can include an inner ring and an outer ring. The outer ring can be integral with one or more support ribs disposed on the rear side of the faucet holder. The outer ring can be integral with a rib at four points, each point 90 degrees apart.

One or more mount holes can be defined on the rear side of the faucet holder. The one or more mount holes can each be defined in the one or more support ribs and can include a material support ring. The body can be integrally formed via molding or additive manufacturing.

In accordance with at least one aspect of this disclosure, a sink can include a plastic body defining a bowl and a faucet holder, wherein the faucet holder includes at least a faucet hole defined through the faucet holder, a faucet mounted to the faucet holder at the faucet hole, and two faucet control holes defined through the faucet holder. At least one of the faucet control holes or the faucet hole can include at least one material support ring defined on a rear side of the faucet holder to provide additional support to the faucet and/or faucet controls. The sink can include any other suitable features disclosed herein.

In accordance with at least one aspect of this disclosure, a sink can include a plastic body defining a bowl and a backsplash, wherein at least one of the bowl or the backsplash is configured to be a faucet holder, wherein the faucet holder includes at least one faucet hole location and/or faucet control location having a support structure on a rear side of the faucet holder that is configured to allow a user to selectively remove material from the plastic body to define one or more faucet holes and/or faucet control holes at the at least one faucet hole location and/or faucet control location.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
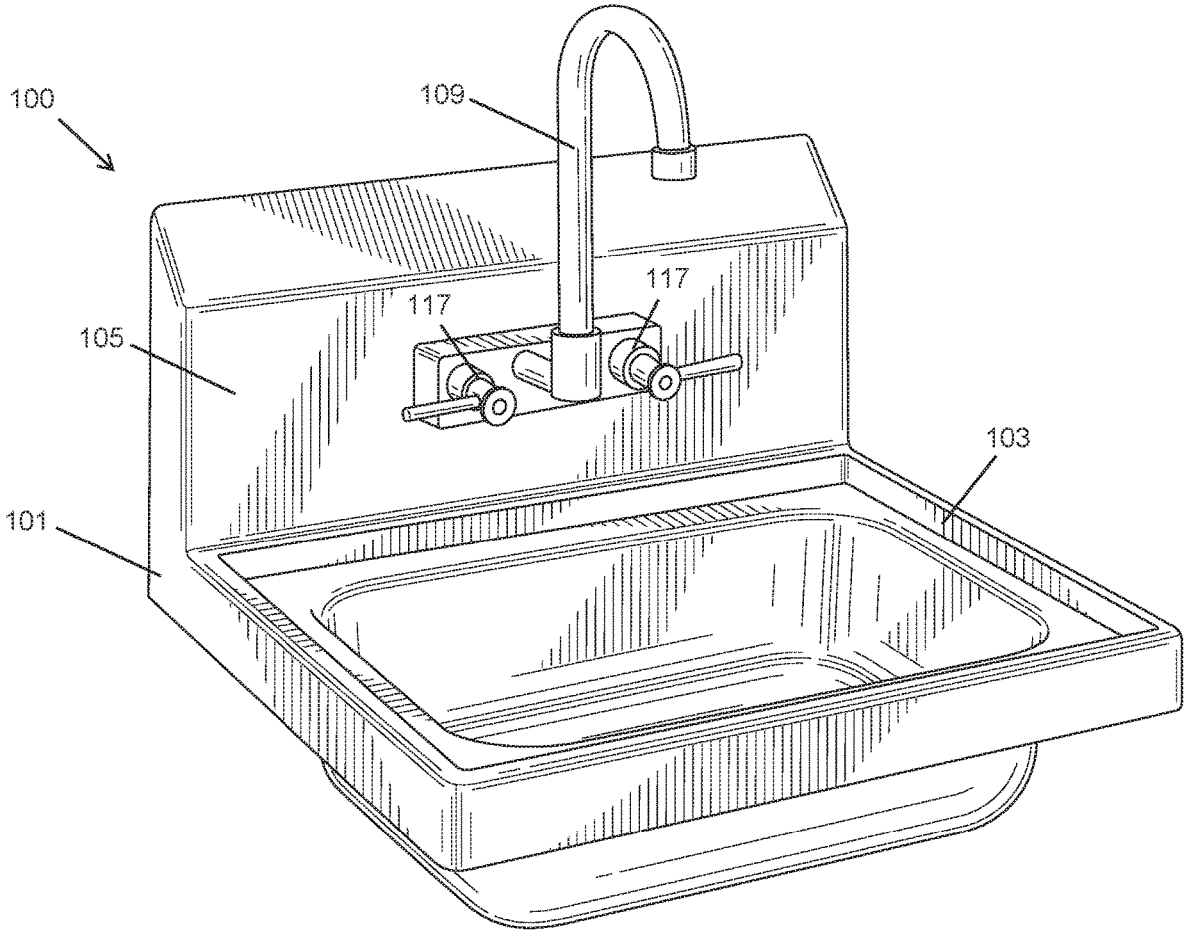
FIG. 1 is a perspective view of an embodiment of a sink in accordance with this disclosure, shown having a faucet and faucet controls disposed thereon.

Reference will now be made to the drawings wherein like reference numerals identify similar structural features or aspects of the subject disclosure. For purposes of explanation and illustration, and not limitation, an illustrative view of an embodiment of a sink in accordance with the disclosure is shown in FIG. 1 and is designated generally by reference character 100. Other embodiments and/or aspects of this disclosure are shown in FIGS. 2-7. The systems and methods described herein can be used to improve health safety, for example, as well as provide stronger structures for sinks.

Figure 2:
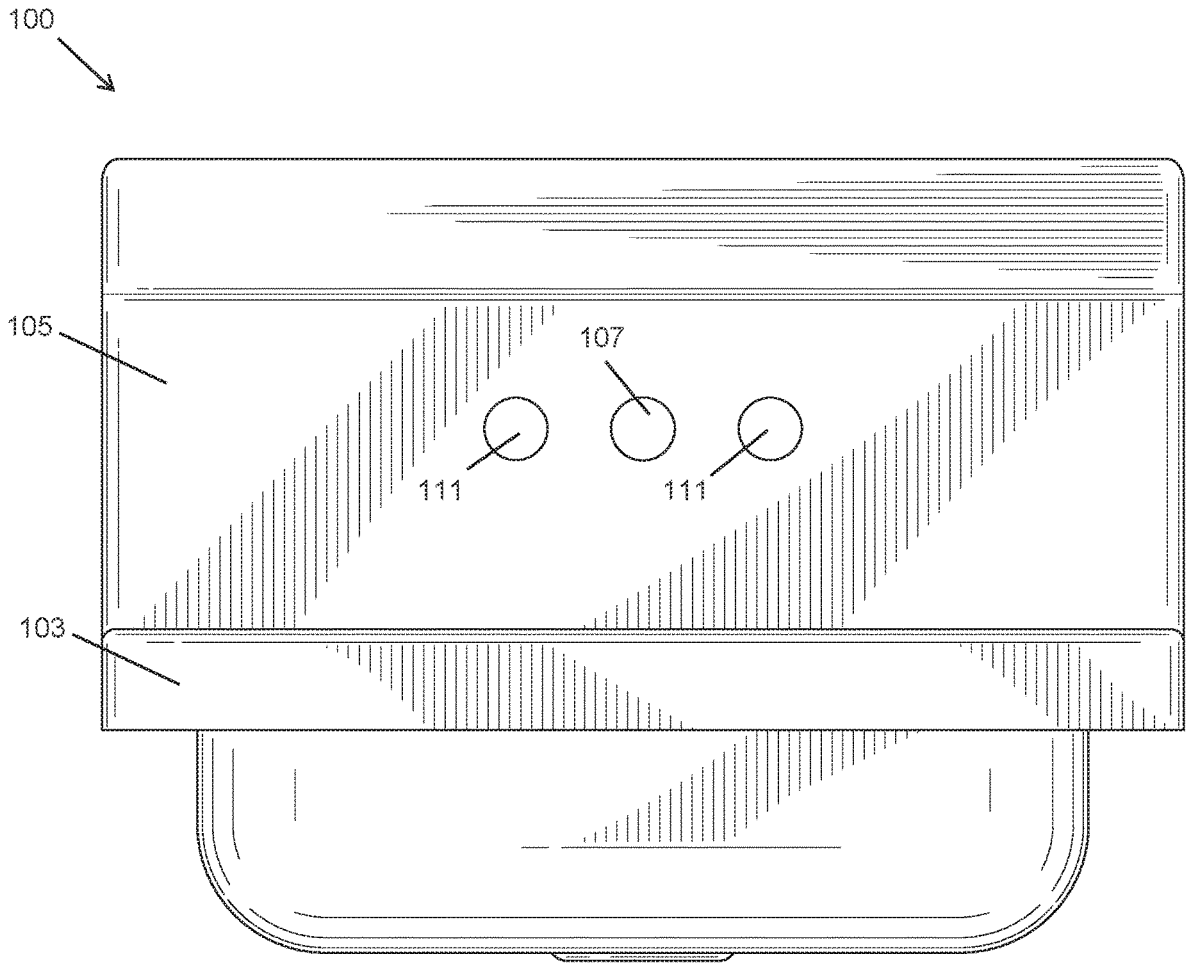
FIG. 2 is a front view of the embodiment of FIG. 1, shown without the faucet and faucet controls.

Referring to FIGS. 1-7, in accordance with at least one aspect of this disclosure a sink 100 can include a body 101 defining a bowl 103 and a faucet holder 105. The body 101 can be formed of an antimicrobial material, or any other suitable material. The faucet holder 105 includes at least a faucet hole 107 (e.g., as shown in FIG. 2) defined through the faucet holder 105, and a faucet 109 mounted to the faucet holder 105 at the faucet hole 107. The anti-microbial material can be an antimicrobial plastic, for example, or any other suitable material.

In certain embodiments, the at least one faucet holder 105 can include at least one faucet control hole 111 defined through the faucet holder 105. For example, as shown, the faucet holder 105 can include two faucet control holes 111 defined through the faucet holder 105.

Figure 3:
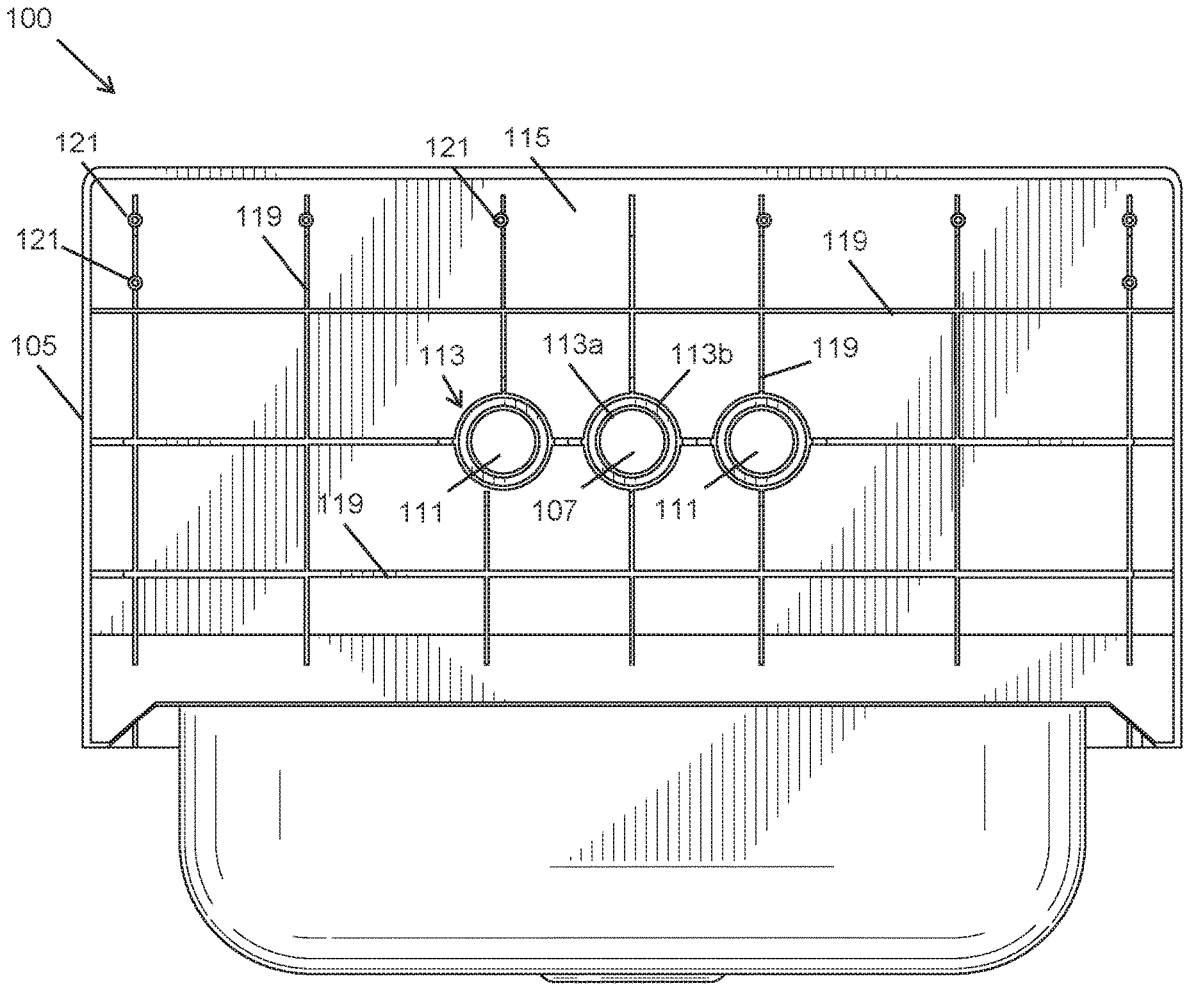
FIG. 3 is a rear view of the embodiment of FIG. 1, shown without the faucet and faucet controls.
Figure 4:
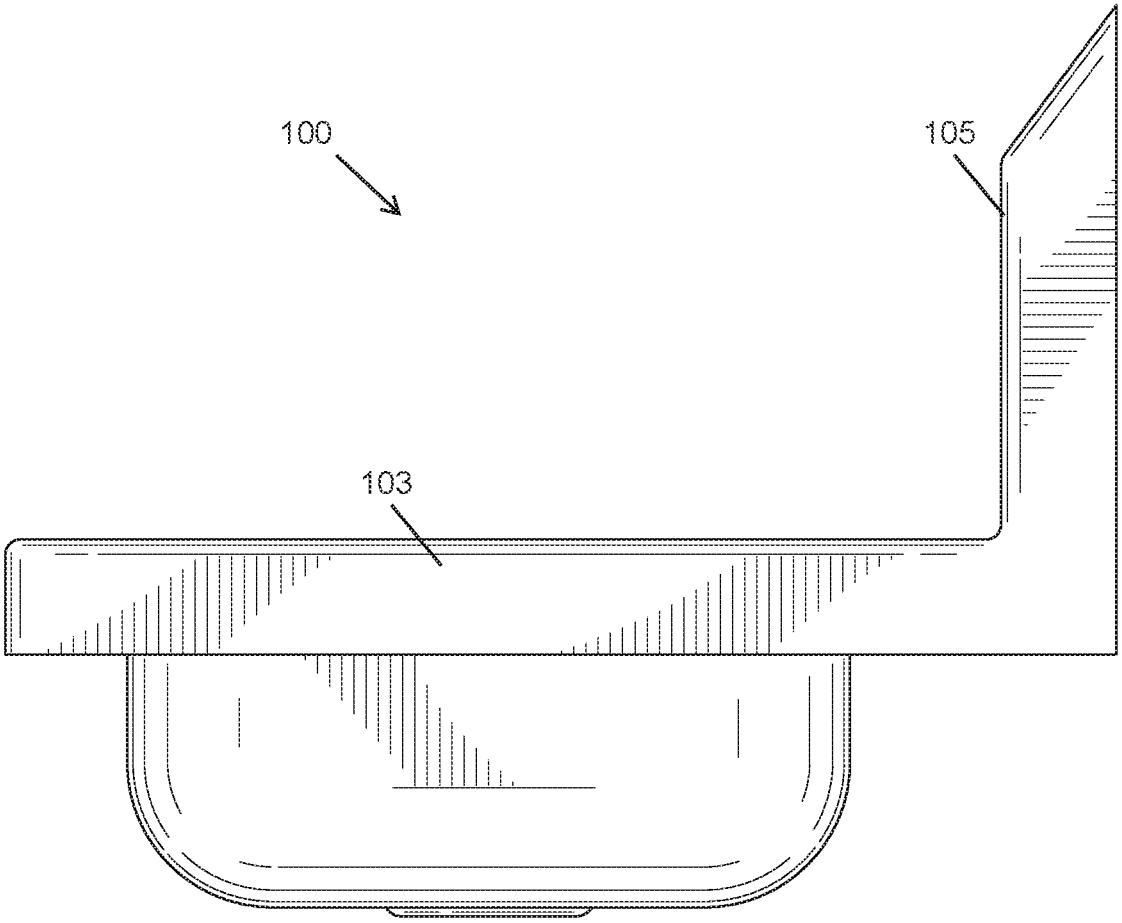
FIG. 4 is a side view of the embodiment of FIG. 1, shown without the faucet and faucet controls.
Figure 5:
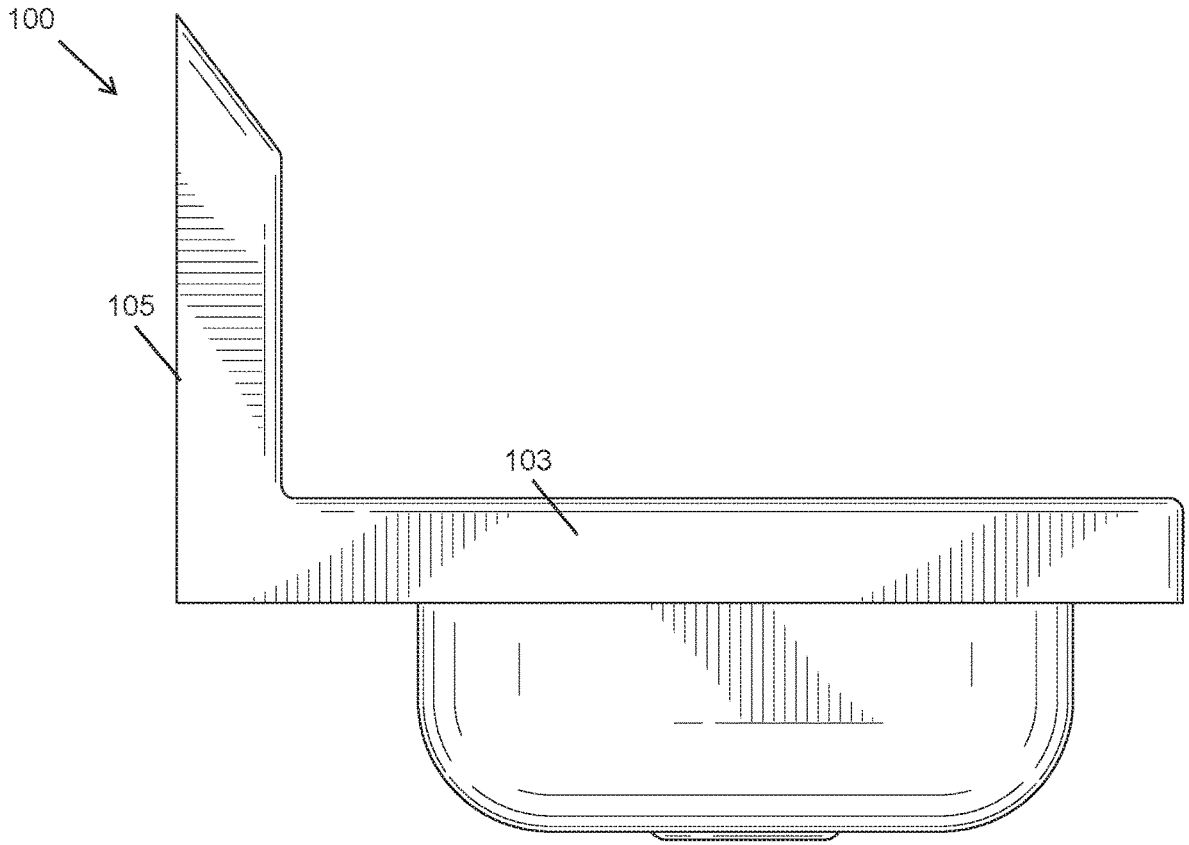
FIG. 5 is an opposite side view of the embodiment of FIG. 1, shown without the faucet and faucet controls.
Figure 6:
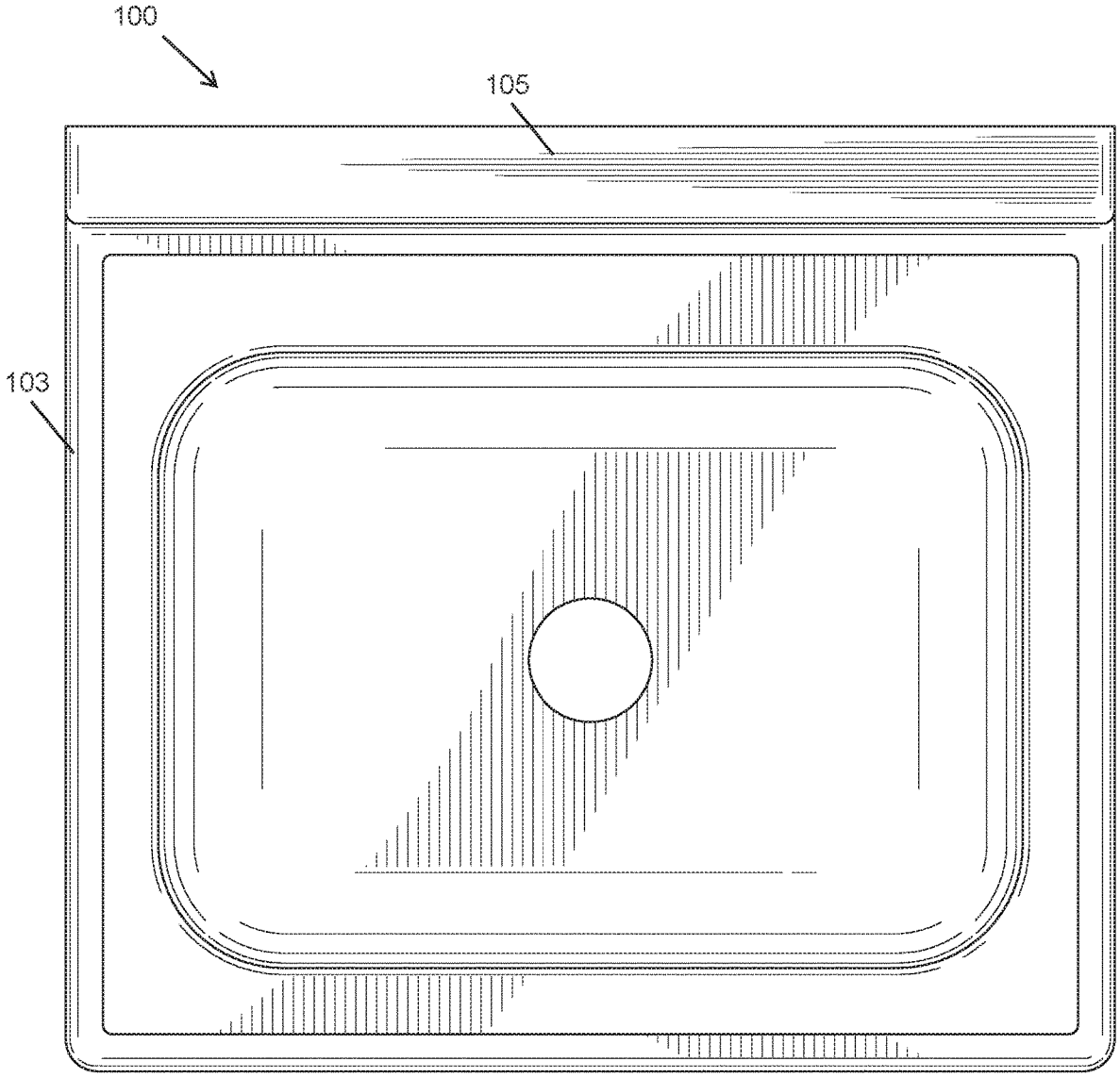
FIG. 6 is a top down view of the embodiment of FIG. 1, shown without the faucet and faucet controls.
Figure 7:
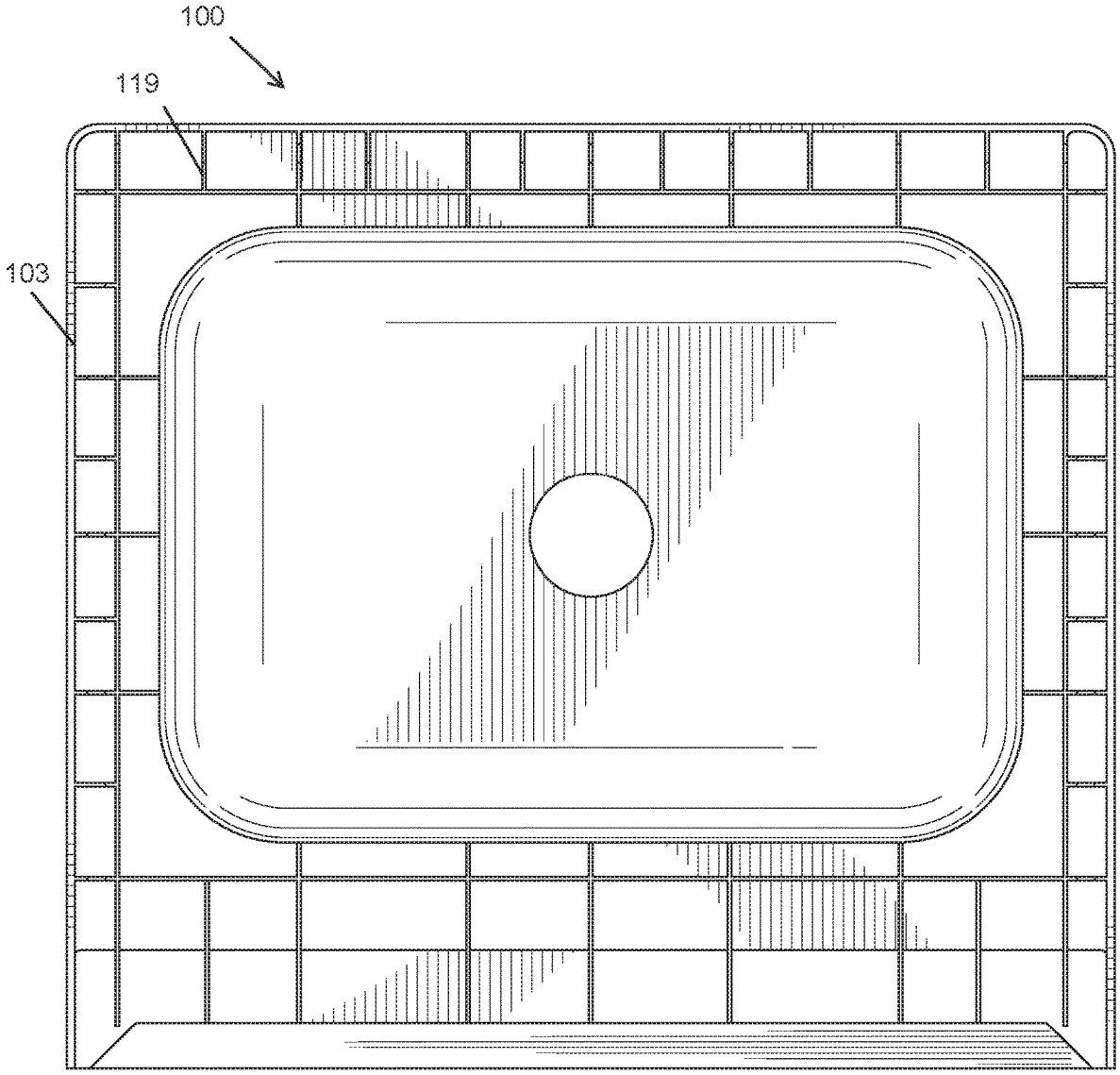
FIG. 7 is a bottom up view of the embodiment of FIG. 1, shown without the faucet and faucet controls.
Figure 8:
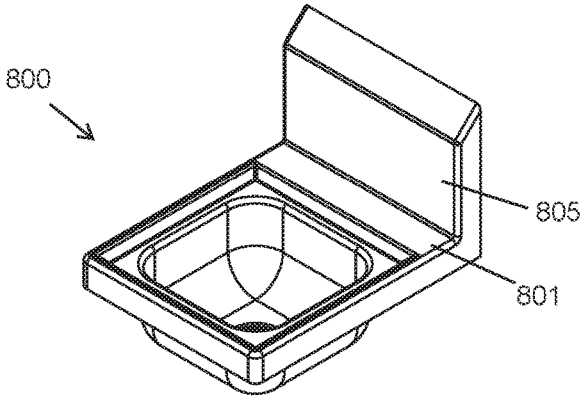
FIG. 8 is a perspective view of an embodiment of a sink in accordance with this disclosure, shown not having faucet or control holes defined therethrough, and having two locations for possible faucet and/or control holes.
Figure 9:
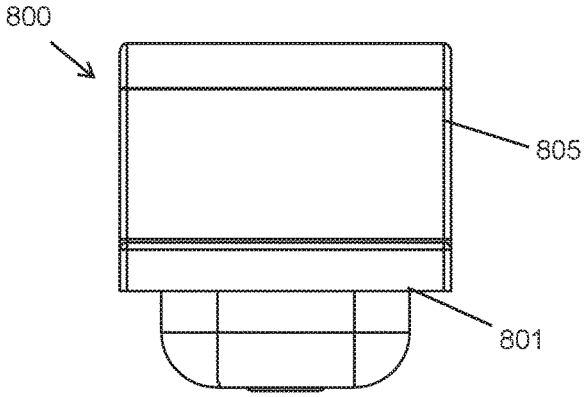
FIG. 9 is a front view of the embodiment of FIG. 8.
Figure 10:
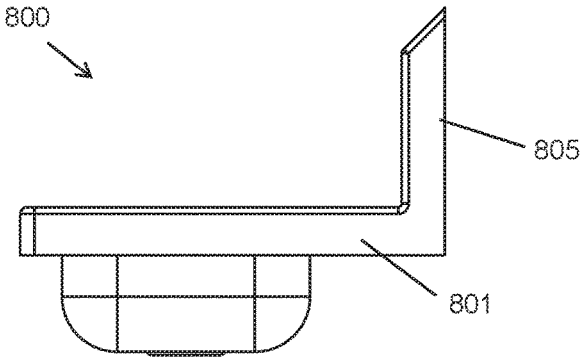
FIG. 10 is a side view of the embodiment of FIG. 8.
Figure 11:
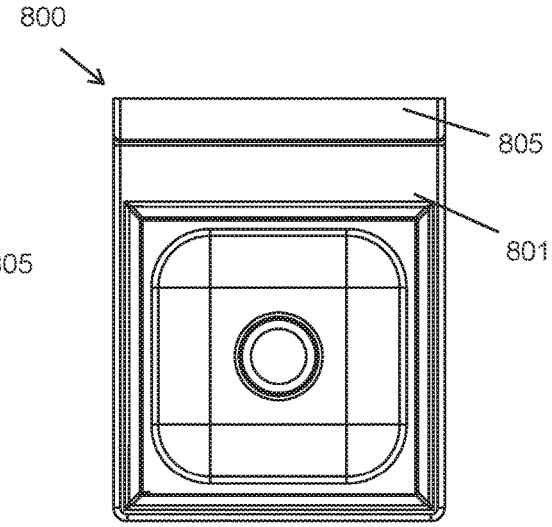
FIG. 11 is a top down view of the embodiment of FIG. 8.
Figure 12:
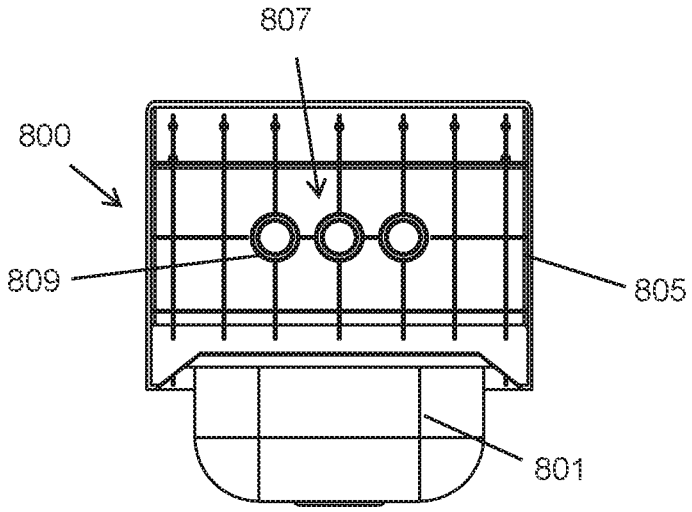
FIG. 12 is a rear view of the embodiment of FIG. 8.
Figure 13:
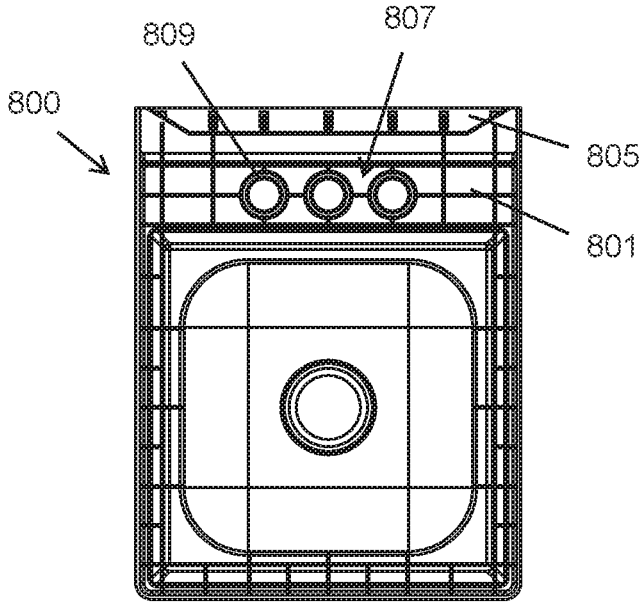
FIG. 13 is a bottom up view of the embodiment of FIG. 8.

Referring additionally to FIG. 3, at least one of the faucet control holes 111 or the at least one faucet hole 107 can include at least one material support ring 113 defined on a rear side 115 of the faucet holder 105 to provide additional support to the faucet 109 and/or faucet controls 117 when mounted. The at least one material support ring 113 can extend outward from a rear side 115 of the faucet holder 105 to form a cylindrical shape, for example. Any other shape is contemplated herein.

In certain embodiments, the at least one material support ring 113 can include an inner ring 113*a* and an outer ring 113*b*. The outer ring 113*b* can be integral with one or more support ribs 119 disposed on the rear side 115 of the faucet holder 105. The outer ring 113*b* can be integral with a rib 119 at four points, each point 90 degrees apart as shown. This can provide additional support to stresses in all directions from use of the faucet and/or controls. Any other suitable configuration is contemplated herein.

In certain embodiments, as shown in FIGS. 8-13, the at least one of the faucet control holes 111 or the at least one faucet hole 107 may not be defined through the material completely, but merely the support ring 113 may be provided such that a user can remove material (e.g., by drilling) to open any desired faucet control hole 111 or faucet hole 107. While the faucet holder 105 is shown as the backsplash in FIGS. 1-7, as shown in FIGS. 8-13, the locations for one or more of the defined or undefined faucet control holes 111 or faucet holes 107 can be on the bowl and/or the backsplash such that the faucet holder can be the bowl or the backsplash (e.g., 105) in certain embodiments.

One or more mount holes 121 can be defined on the rear side 115 of the faucet holder 105. The one or more mount holes 121 can each be defined in the one or more support ribs 119 and can include a material support ring as shown. This can cause the mount holes 121 to be reinforced. However, any other suitable location for the holes 121 is contemplated herein.

As appreciated by those having ordinary skill in the art, the body 101 can be integrally formed via molding or additive manufacturing. Any other suitable method is contemplated herein. It is also contemplated that any suitable demarcation of pieces for the body 101 is possible, and the body 101 does not have to be integral.

In accordance with at least one aspect of this disclosure, a sink 100 can include a plastic body defining a bowl and a faucet holder, wherein the faucet holder includes at least a faucet hole defined through the faucet holder, a faucet mounted to the faucet holder at the faucet hole, and two faucet control holes defined through the faucet holder. At least one of the faucet control holes or the faucet hole can include at least one material support ring defined on a rear side of the faucet holder to provide additional support to the faucet and/or faucet controls. The sink can include any other suitable features disclosed herein.

In accordance with at least one aspect of this disclosure, as shown in FIGS. 8-13, a sink 800 can include a plastic body defining a bowl 801 and a backsplash 805, wherein at least one of the bowl 801 or the backsplash 805 is configured to be a faucet holder. The faucet holder can include at least one faucet hole location and/or faucet control location 807 having a support structure 809 on a rear side of the faucet holder that is configured to allow a user to selectively remove material from the plastic body to define one or more faucet holes and/or faucet control holes at the at least one faucet hole location and/or faucet control location 807. As shown, in certain embodiments, the one or more faucet hole locations and/or faucet control locations 807 can be on both the bowl 801 or the backsplash 805.

Any suitable combination(s) of any disclosed embodiments and/or any suitable portion(s) thereof is contemplated therein as appreciated by those having ordinary skill in the art.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A sink, comprising:

a body defining a bowl and a faucet holder, wherein the body is formed of an antimicrobial material, wherein the faucet holder includes at least a faucet hole defined through the faucet holder; and a faucet mounted to the faucet holder at the faucet hole, wherein the faucet holder includes two faucet control holes defined through the faucet holder, and wherein at least one of the faucet control holes or the faucet hole includes at least one material support ring defined on a rear side of the faucet holder to provide additional support to the faucet and/or faucet controls, wherein the at least one material support ring extends outward from the rear side of the faucet holder to form a cylindrical shape, and wherein the at least one material support ring includes an inner ring and an outer ring.

2. The sink of claim 1, wherein the anti-microbial material is an antimicrobial plastic.

3. The sink of claim 1, wherein the outer ring is integral with one or more support ribs disposed on the rear side of the faucet holder.

4. The sink of claim 3, wherein the outer ring is integral with individual support ribs at four individual points, each point 90 degrees apart.

5. The sink of claim 4, further comprising one or more mount holes defined on the rear side of the faucet holder.

6. The sink of claim 5, wherein the one or more mount holes are each defined in the one or more support ribs and include a material support ring.

7. The sink of claim 6, wherein the body is integrally formed via molding or additive manufacturing.

8. A sink, comprising:

a plastic body defining a bowl and a faucet holder, wherein the faucet holder includes at least a faucet hole defined through the faucet holder;

a faucet mounted to the faucet holder at the faucet hole; and two faucet control holes defined through the faucet holder wherein at least one of the faucet control holes or the faucet hole includes at least one material support ring defined on a rear side of the faucet holder to provide additional support to the faucet and/or faucet controls, wherein the at least one material support ring extends outward from the rear side of the faucet holder to form a cylindrical shape, and wherein the at least one material support ring includes an inner ring and an outer ring.

9. The sink of claim 8, wherein the outer ring is integral with one or more support ribs disposed on the rear side of the faucet holder.

10. The sink of claim 9, wherein the outer ring is integral with individual support ribs at four individual points, each point 90 degrees apart.

11. The sink of claim 10, further comprising one or more mount holes defined on the rear side of the faucet holder.

12. The sink of claim 11, wherein the one or more mount holes are each defined in the one or more support ribs and include a material support ring.

* * * * *